US007418235B2

(12) United States Patent
Nonaka et al.

(10) Patent No.: US 7,418,235 B2
(45) Date of Patent: Aug. 26, 2008

(54) METHOD AND APPARATUS FOR IMAGE FORMING

(75) Inventors: Manabu Nonaka, Kanagawa (JP); Yohzoh Dohki, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 491 days.

(21) Appl. No.: 11/125,758

(22) Filed: May 10, 2005

(65) Prior Publication Data

US 2005/0254872 A1 Nov. 17, 2005

(30) Foreign Application Priority Data

May 11, 2004 (JP) ..... 2004-141258

(51) Int. Cl.
*G03G 15/00* (2006.01)

(52) U.S. Cl. ..... 399/401; 399/405

(58) Field of Classification Search ..... 399/401, 399/402, 405, 397
See application file for complete search history.

(56) References Cited

U.S. PATENT DOCUMENTS 4,986,529 A * 1/1991 Agarwal et al. ..... 271/291
5,610,724 A * 3/1997 Kaneko et al. ..... 358/400
5,708,954 A * 1/1998 Ando et al. ..... 399/402
6,055,410 A * 4/2000 Marumoto et al. ..... 399/392
6,397,023 B1 * 5/2002 Underwood et al. ..... 399/82
6,603,954 B1 * 8/2003 Zoltner et al. ..... 399/405
6,697,177 B1 * 2/2004 Tomoe et al. ..... 358/498
6,873,822 B2 * 3/2005 Tomono et al. ..... 399/401
6,937,829 B2 * 8/2005 Sato et al. ..... 399/82
2002/0093135 A1 * 7/2002 Fetherolf et al. ..... 271/303
2002/0159805 A1 * 10/2002 Sato ..... 399/405
2003/0155702 A1 8/2003 Togashi et al.

FOREIGN PATENT DOCUMENTS

JP 11-286363 10/1999
JP 2003-292224 10/2003
JP 2003-341902 12/2003

* cited by examiner

*Primary Examiner*—Anthony H. Nguyen
(74) *Attorney, Agent, or Firm*—Cooper & Dunham, LLP

(57) ABSTRACT

An image forming apparatus includes a reverse conveyance path, a straight conveyance path, a duplex conveyance path, and two branch boards. The reverse conveyance path is used to output a recording sheet face down. The straight conveyance path is used to straight output a recording sheet face up. The duplex conveyance path is used to output a recording sheet on both sides of which images are formed. The two branch boards sandwich the straight conveyance path. At least one of the two branch boards swings at a time to switch to any one of the reverse conveyance path, the straight conveyance path, and the duplex conveyance path.

33 Claims, 13 Drawing Sheets

METHOD AND APPARATUS FOR IMAGE FORMING

FIELD

The present specification describes a method and apparatus for image forming, and more particularly a method and apparatus for image forming that are capable of selectively switching among three conveyance paths for conveying recording sheets.

DISCUSSION OF THE BACKGROUND

As one of image forming apparatuses such as a printer, a facsimile, a copier, and a multifunction machine having printer, facsimile, and copier functions, an inkjet recording device is known. In the inkjet recording device, a recording head including a liquid drop discharging head for discharging a liquid drop (i.e., an ink drop) of recording liquid emits the liquid drop onto a conveyed recording sheet, so that the liquid drop is settled on the recording sheet to form (i.e., record or print) an image. The recording sheet is not restricted to paper, but also includes any medium on which the liquid drop can settle, such as a recorded medium, a recording medium, and a transfer material.

There are multiple types of the liquid drop discharging head, such as piezo, thermal, and electrostatic types. The piezo type uses an electromechanical sensing element such as a piezoelectric device. The thermal type uses an electric heat sensing element such as a heat generating resistance body provided in a discharging room to generate a bubble by boiling an ink film, so that pressure of the bubble discharges the ink drop. The electrostatic type uses a vibration board forming walls of the discharging room, so that the vibration board deformed by an electrostatic force discharges the ink drop.

In the image forming apparatus using the above inkjet recording method, however, ink on the recording sheet does not completely dry soon after an image is formed. To solve this problem, a straight output method is generally employed. According to the straight output method, the recording sheet is straight conveyed after an image is formed on the recording sheet, and then output face up.

A reverse output method is employed to correct curling generated in the recording sheet. According to the reverse output method, the recording sheet on which an image is formed is reversed, conveyed, and then output face down.

A sheet conveying apparatus for conveying the recording sheet is used in the image forming apparatus. In the sheet conveying apparatus, switching is performed among three conveyance paths, that is, a straight conveyance path, an upper conveyance path, and a lower conveyance path. The sheet conveying apparatus includes two path selectors and two drivers for independently operating the two path selectors. The two path selectors are rotatable about a single axis and positioned parallel to each other in such a manner as to sandwich a plane of sheet conveyance. One of the drivers drives one of the path selectors to close the straight conveyance path and to open the upper conveyance path. The other driver drives the other path selector to close the straight conveyance path and to open the lower conveyance path.

SUMMARY

This patent specification describes a novel image forming apparatus. The image forming apparatus includes a reverse conveyance path, a straight conveyance path, a duplex conveyance path, and two branch boards. The reverse conveyance path is used to output a recording sheet face down. The straight conveyance path is used to straight output a recording sheet face up. The duplex conveyance path is used to output a recording sheet on both sides of which images are formed. The two branch boards sandwich the straight conveyance path. At least one of the two branch boards swings to switch to any one of the reverse conveyance path, the straight conveyance path, and the duplex conveyance path.

The one of the two branch boards is rotatably supported by the other of the two branch boards.

The image forming apparatus further includes a straight output tray. The straight output tray is used for the straight conveyance path and swings the one of the two branch boards when the straight output tray is opened. The straight output tray is interlocked with a member interlocking the one of the two branch boards with the straight output tray without interconnecting the one of the two branch boards with the straight output tray. The member includes an elastic member.

The image forming apparatus further includes an image forming unit. The image forming unit includes a liquid drop discharging head for discharging a liquid drop of recording liquid to form an image on a recording sheet. The two branch boards are arranged at a position where the recording liquid landed on the recording sheet dries.

Viewing as a structure of a sheet conveying apparatus used in the image forming apparatus, the sheet conveying apparatus includes a first conveyance path, a second conveyance path, a third conveyance path, and two branch boards. The first conveyance path is configured to output a recording sheet face down. The second conveyance path is configured to output a recording sheet face up. The third conveyance path is configured to output a recording sheet on both sides of which images are formed. The two branch boards are configured to sandwich the second conveyance path. One of the two branch boards independently swings to switch to any one of the first conveyance path and the second conveyance path. The two branch boards simultaneously swing to switch to the third conveyance path.

The two branch boards are arranged in a manner that sides of the two branch boards form a clothespin-like shape. Further, the two branch boards are rotatably connected with each other. The one of the two branch boards is rotatably supported by the other of the two branch boards.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
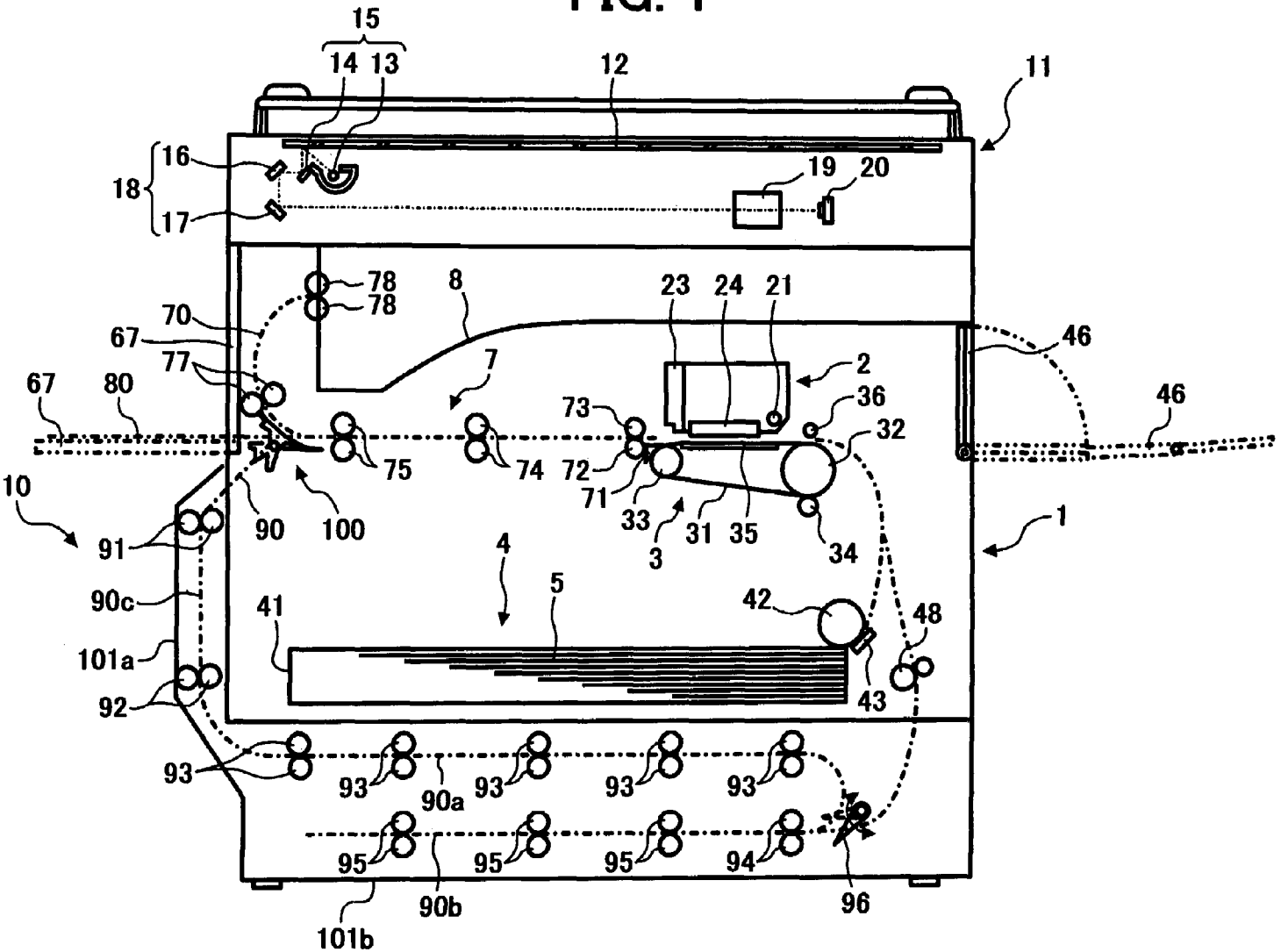
FIG. 1 is a schematic illustration showing an entire structure of an image forming apparatus according to an exemplary embodiment of this disclosure.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIGS. 1 and 2, an image forming apparatus according to embodiments of this disclosure is explained.

As illustrated in FIG. 1, the image forming apparatus includes a body 1, a bypass tray 46, and a straight output tray 67.

The body 1 includes a paper tray 4, an image reader 11, a belt conveyer 3, an image forming unit 2, a straight conveyer 7, an output tray 8, a duplex unit 10, a branch mechanism 100, a reverse conveyance path 70, a straight conveyance path 80, and a duplex conveyance path 90.

The paper tray 4 includes a sheet 5, a paper cassette 41, a paper tray roller 42, and a friction pad 43. The image reader 11 includes an exposure glass 12, a scanning optical system 15 including a light source 13 and a mirror 14, a scanning optical system 18 including mirrors 16 and 17, a lens 19, and an image reading element 20. The belt conveyer 3 includes a conveyance belt 31, a conveyance roller 32, a driven roller 33, a charging roller 34, a guide 35, and a pressure roller 36. The image forming unit 2 includes a recording head 24, a carriage 23, and a carriage guide 21. The straight conveyer 7 includes a separation nail 71, a feeding roller 72, a spur 73, and fed sheet conveyance roller pairs 74 and 75. The duplex unit 10 includes a vertical conveyer 101*a* and a horizontal conveyer 101*b*. The reverse conveyance path 70 includes a sheet reverse roller pair 77 and a reversed sheet feeding roller pair 78.

The vertical conveyer 101*a* includes a vertical duplex conveyance route 90*c*. The horizontal conveyer 101*b* includes a horizontal conveyance route 90*a* and a switchback conveyance route 90*b*. The vertical duplex conveyance route 90*c* includes a duplex entrance roller pair 91 and a conveyance roller pair 92. The horizontal conveyance route 90*a* includes five duplex conveyance roller pairs 93. The switchback conveyance route 90*b* includes a duplex exit roller pair 94, tree duplex conveyance roller pairs 95, a switching board 96, and a conveyance roller pair 48.

The body 1 is configured to include various parts for forming an image. The bypass tray 46 is configured to be opened from one side of the body 1 and load the sheets 5. The straight output tray 67 is configured to be opened from the other side of the body 1 and receive the sheet 5 fed through the straight conveyance path 80.

The paper tray 4 is configured to be arranged at a lower part of the body 1 and load the sheets 5. The image reader 11 is configured to be arranged at an upper part of the body 1 above the output tray 8 and function as an input system for inputting image data. The belt conveyer 3 is configured to convey the sheet 5 on a position opposing to the image forming unit 2. The image forming unit 2 is configured to discharge a liquid drop onto the sheet 5 to form an image. The straight conveyer 7 is configured to convey the sheet 5 fed from the belt conveyer 3 to the branch mechanism 100. The output tray 8 is configured to be arranged at an upper part of the body 1 and receive the sheet 5 fed through the reverse conveyance path 70. The duplex unit 10 is configured to be arranged at a bottom of the body 1 and integrally include the vertical conveyer 101*a* and the horizontal conveyer 101*b*. The branch mechanism 100 is configured to be arranged on a downstream side of the fed sheet conveyance roller pair 75 and switch a conveyance path among the reverse conveyance path 70, the straight conveyance path 80, and the duplex conveyance path 90. The reverse conveyance path 70 is configured to function as a first conveyance path through which the sheet 5 is fed onto the output tray 8 face down. The straight conveyance path 80 is configured to function as a second conveyance path through which the sheet 5 is fed onto the straight output tray 67 face up. The duplex conveyance path 90 is configured to function as a third conveyance path through which the sheet 5 is conveyed downward into the duplex unit 10.

The sheet 5 is configured to be fed and conveyed so as to have an image formed thereon. The paper cassette 41 is configured to store a large number of the sheets 5. The paper tray roller 42 and the friction pad 43 are configured to separate and feed the sheets 5 loaded in the paper cassette 41 one by one.

The exposure glass 12 is configured to have an original placed thereon so that an image on the original can be scanned. The scanning optical system 15 is configured to move to scan an image on the original. The light source 13 is configured to emit a light beam onto the original. The mirror 14 is configured to deflect the light beam reflected by the original. The scanning optical system 18 is configured to move to scan an image on the original. The mirrors 16 and 17 are configured to deflect the light beam deflected by the mirror 14. The lens 19 is configured to irradiate the light beam deflected by the mirrors 16 and 17 into the image reading element 20. The image reading element 20 is configured to be arranged at a rear of the lens 19 and read the scanned image as an image signal.

The conveyance belt 31 is configured to rotate in a sheet conveyance direction (i.e., a sub-scanning direction) to electrostatically attract and convey the sheet 5. The conveyance roller 32 and the driven roller 33 are configured to support and rotate the conveyance belt 31. The charging roller 34 is configured to charge a surface of the conveyance belt 31. The guide 35 is configured to guide the conveyance belt 31 in an area opposing to the image forming unit 2. The pressure roller 36 is configured to press the sheet 5 onto the conveyance belt 31 at a position opposing to the conveyance roller 32.

The recording head 24 is configured to be a shuttle type head and discharge a liquid drop of any one of cyan, magenta, yellow, and black colors. The carriage 23 is configured to carry the recording head 24. The carriage guide 21 is configured to guide the carriage 23 to move in a main scanning direction (i.e., a direction vertical to the sheet conveyance direction).

The separation nail 71 is configured to separate the sheet 5 from the conveyance belt 31 after an image is formed on the sheet 5. The feeding roller 72 is configured to contact an under surface of the separated sheet 5 and feed the sheet 5. The spur 73 is configured to oppose to the feeding roller 72. The fed sheet conveyance roller pairs 74 and 75 are configured to convey the sheet 5 fed by the feeding roller 72 and the spur 73. The vertical conveyer 101*a* is configured to convey downward the sheet 5 conveyed through the duplex conveyance path 90 to the horizontal conveyer 101*b*. The horizontal conveyer 101*b* is configured to convey in a horizontal direction the sheet 5 conveyed by the vertical conveyer 101*a*. The sheet reverse roller pair 77 and the reversed sheet feeding roller pair 78 are configured to reverse and feed the sheet 5 fed by the fed sheet conveyance roller pair 75 onto the output tray 8.

The vertical duplex conveyance route 90*c* is configured to receive the sheet 5 conveyed through the duplex conveyance path 90 at a side part of the body 1 and convey the received sheet 5 downward. The horizontal conveyance route 90*a* and the switchback conveyance route 90*b* are configured to convey the sheet 5 in the horizontal direction after the sheet 5 passes through the vertical duplex conveyance route 90*c*. The duplex entrance roller pair 91 is configured to feed the sheet 5 conveyed through the duplex conveyance path 90 downward through the vertical duplex conveyance route 90*c*. The conveyance roller pair 92 is configured to feed the sheet 5 conveyed through the vertical duplex conveyance route 90*c* to the horizontal conveyance route 90*a*. The duplex conveyance roller pairs 93 are configured to feed the sheet 5 fed by the conveyance roller pair 92 through the horizontal conveyance route 90*a*. The duplex exit roller pair 94 is configured to reverse and feed back the sheet 5 conveyed from the horizontal conveyance route 90*a*. The duplex conveyance roller pairs 95 are configured to feed the sheet 5 conveyed from the horizontal conveyance route 90*a*. The switching board 96 is configured to pivot to switch between a conveyance path for feeding the sheet 5 from the horizontal conveyance route 90*a* to the switchback conveyance route 90*b* and a conveyance path for feeding back the sheet 5 from the switchback conveyance route 90*b* to the conveyance roller pair 48. The conveyance roller pair 48 is configured to feed the sheet 5 fed from the switching board 96 to the belt conveyer 3.

The sheet 5 is fed one by one from the paper tray 4. While the belt conveyer 3 conveys the sheet 5 on the position opposing to the image forming unit 2, the image forming unit 2 discharges a liquid drop onto one side of the sheet 5 to form (i.e., record) an image. For one-sided printing, the sheet 5 is fed through the straight conveyer 7 onto the output tray 8. For duplex printing, the sheet 5 is fed from a middle position on the straight conveyer 7 into the duplex unit 10. Then, the sheet 5 is switched back and fed to the belt conveyer 3 again. After an image is formed on the other side of the sheet 5, the sheet 5 is fed onto the output tray 8.

The sheet 5 is manually inserted into the bypass tray 46 and fed face up by straight output. The sheet 5 is fed one by one from the bypass tray 46. While the belt conveyer 3 conveys the sheet 5 on the position opposing to the image forming unit 2, the image forming unit 2 discharges a liquid drop onto one side of the sheet 5 to form an image. For straight output, the sheet 5 can be fed through the straight conveyer 7 onto the straight output tray 67. When the straight output tray 67 is opened, the sheet 5 fed from the paper tray 4 is also fed onto the straight output tray 67.

In the image reader 11, the scanning optical systems 15 and 18 move to scan an image on an original placed on the exposure glass 12. The image reading element 20 reads the scanned image as an image signal. The read image signal is digitalized and subjected to image processing. Thus, image processed print data can be printed.

The image forming apparatus can receive, via a cable or a network, print data including image data sent from an external host, as an input system for inputting image data (i.e., print data) from which the image forming unit 2 forms an image, including an information processing device such as a personal computer, an image scanning device such as an image scanner, or an imaging device such as a digital camera. The received print data can be processed and printed.

While the carriage 23 moves in the main scanning direction and the belt conveyer 3 conveys the sheet 5 in the sheet conveyance direction, the recording head 24 discharges a liquid drop to form an image. The image forming unit 2 may include a line type head.

The conveyance belt 31 electrostatically attracts and conveys the sheet 5 in a manner that a surface of the sheet 5 opposes to the image forming unit 2, and is laid across the conveyance roller 32 and the driven roller 33. The charging roller 34 to which a high voltage is applied charges a surface of the conveyance belt 31.

The conveyance belt 31 is formed of two layers, that is, a front layer and a back layer (i.e., a medium resistance layer and a grounded layer). The front layer functions as a sheet attraction surface formed of a pure resin material not subjected to resistance control, for example, an ETFE pure material. The back layer is formed of a same material as the front layer and subjected to resistance control with carbon.

To straight convey the sheet 5 on which an image is formed face up, the fed sheet conveyance roller pair 75 feeds the sheet 5 through the straight output path 80 onto the straight output tray 67 which can be opened from the side of the body 1 other than the side to which the bypass tray 46 is attached.

To print an image on the other side of the sheet 5 fed by the fed sheet conveyance roller pair 75, on one side of which an image is already formed, a conveyance path to send the sheet 5 to the duplex unit 10 forms the duplex conveyance path 90.

The switching board 96 can pivot to switch between a switchback position as illustrated with a solid line and a feedback position as illustrated with a broken line in FIG. 1.

Figure 2:
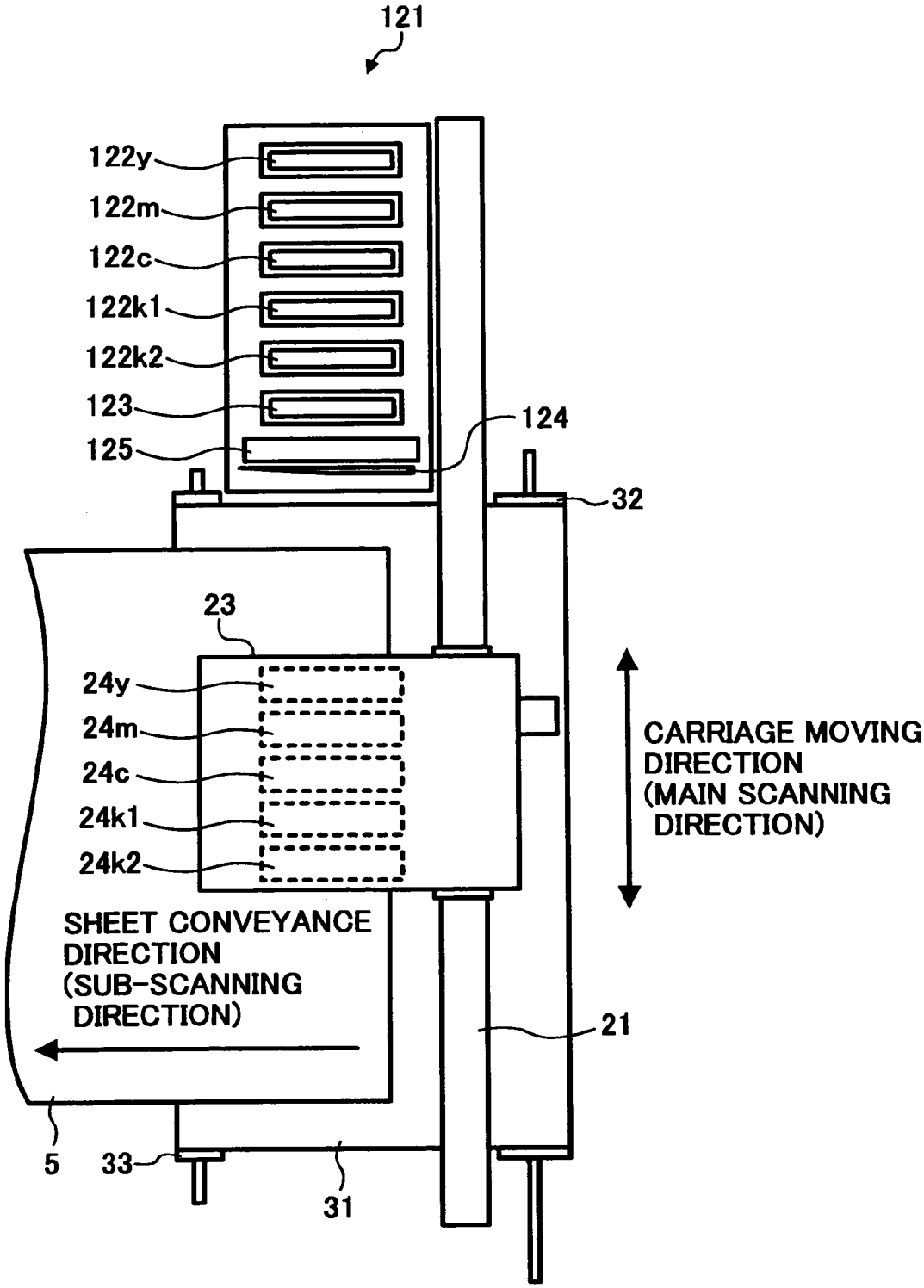
FIG. 2 is a plan view of an image forming unit and a belt conveyer of the image forming apparatus of FIG. 1.

As illustrated in FIG. 2, the image forming unit 2 further includes a maintenance recovery mechanism 121 and liquid drop discharging heads 24*y*, 24*m*, 24*c*, 24*k*1, and 24*k*2. The maintenance recovery mechanism 121 includes moisture retention caps 122*y*, 122*m*, 122*c*, 122*k*1, and 122*k*2, a sucking cap 123, an idle discharge receiver 125, and a wiper blade 124.

The maintenance recovery mechanism 121 is configured to be arranged in a non-printing area on one side of the main scanning direction of the carriage 23 and include a head cleaner for maintaining and recovering a state of a nozzle of the recording head 24. The liquid drop discharging heads 24*y*, 24*m*, 24*c*, 24*k*1, and 24*k*2 are configured to respectively discharge liquid drops in yellow, magenta, cyan, and black colors. The moisture retention caps 122*y*, 122*m*, 122*c*, 122*k*1, and 122*k*2 are configured to respectively cap surfaces of the nozzles of the liquid drop discharging heads 24*y*, 24*m*, 24*c*, 24*k*1, and 24*k*2. The sucking cap 123 is configured to suck a liquid drop. The idle discharge receiver 125 is configured to receive a liquid drop when performing an idle discharge. The wiper blade 124 is configured to wipe the surface of the nozzle of the recording head 24.

A sub tank (not shown) for each color arranged on the carriage 23 supplies ink of each color. An ink cartridge (not shown) for each color, as a main tank attachable to and detachable from the body 1, supplies ink via a tube to replenish the sub tank for each color.

Multiple types of the recording head 24 such as piezo, thermal, electrostatic types and the like can be used. The piezo type uses a piezoelectric device as a pressure generator (i.e., an actuator) for applying pressure on ink in an ink flow route (i.e., a pressure generating room) to deform a vibration board forming walls of the ink flow route, so that a changed volume of the ink flow route discharges an ink drop. The thermal type uses a heat generating resistance body to generate a bubble by boiling ink in the ink flow route, so that pressure of the bubble discharges the ink drop. The electrostatic type uses the vibration board forming the walls of the ink flow route and an electrode, which are opposed with each other, so that the vibration board deformed by an electrostatic force generated between the vibration board and the electrode changes the volume of the ink flow route and discharges the ink drop.

The conveyance belt 31 rotates in the sheet conveyance direction as illustrated in FIG. 2 as a sub-scanning direction motor (not shown) rotates the conveyance roller 32 via a timing belt and a timing roller.

A schematic structure of a controller 200 of the image forming apparatus is explained with reference to FIGS. 3A and 3B.

Figures 3, 3A, 3B:
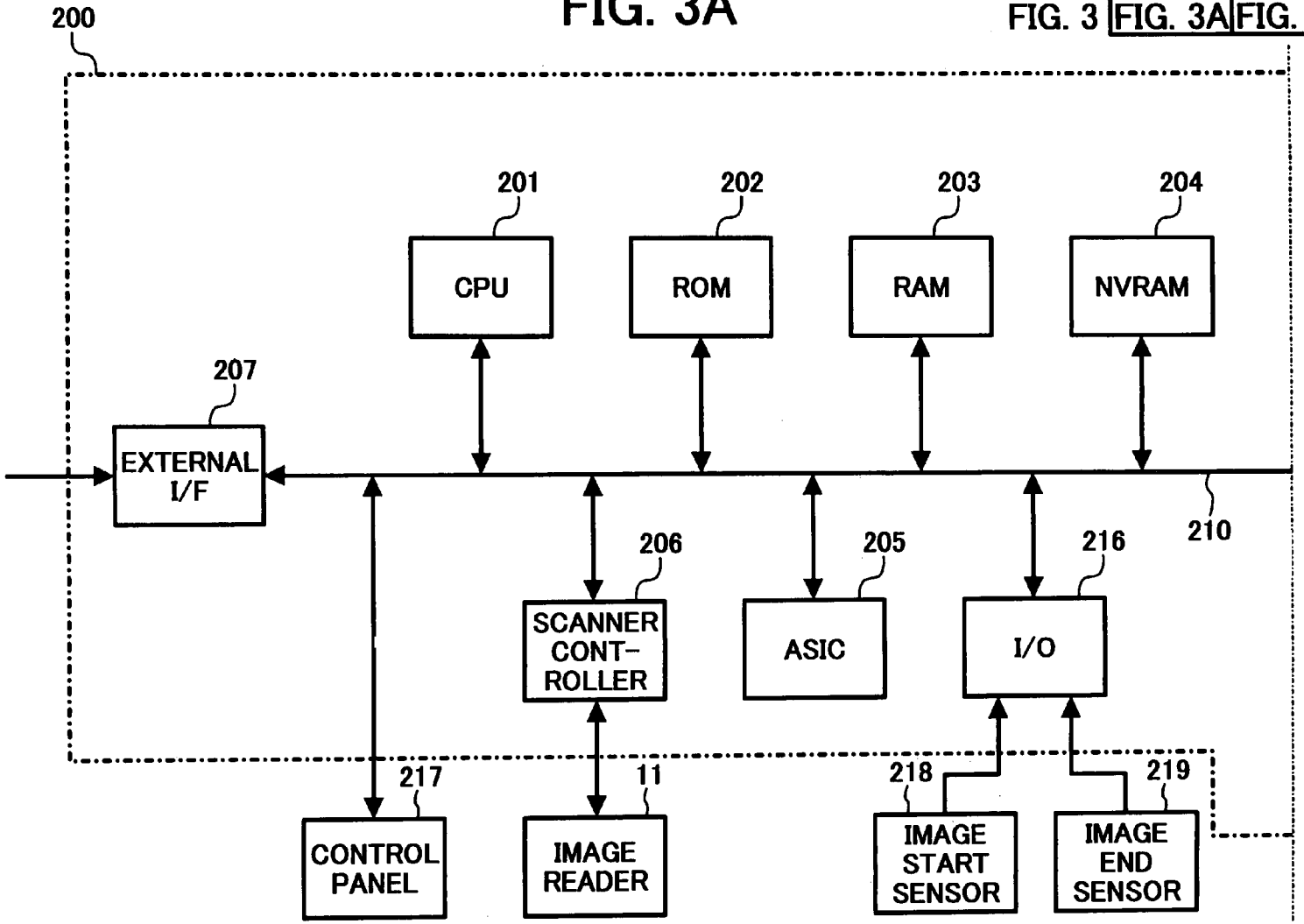
FIGS. 3A and 3B collectively illustrate a schematic block diagram of a controller of the image forming apparatus of FIG. 1.
Figure 3B:
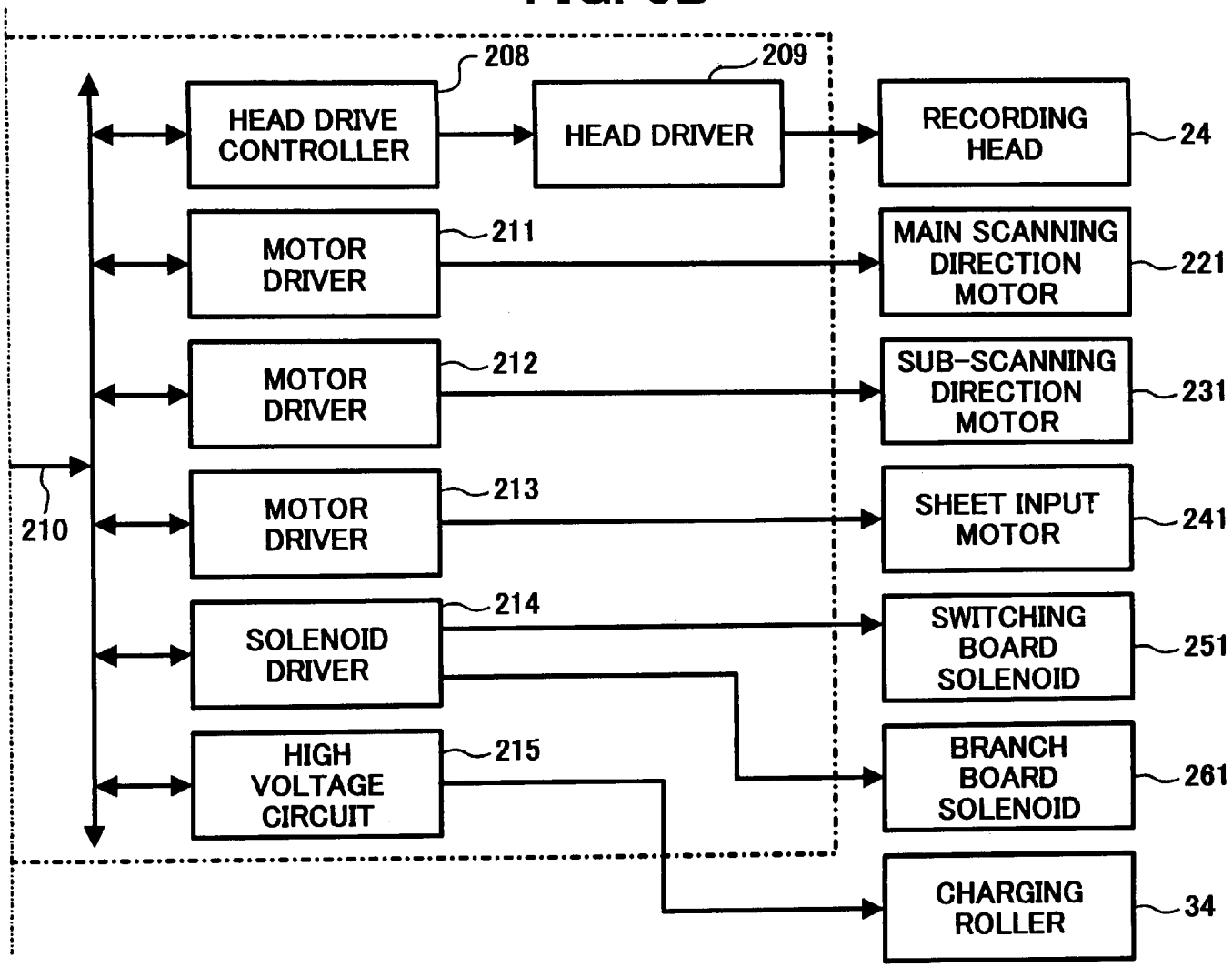

As illustrated in FIGS. 3A and 3B, the body 1 further includes the controller 200, a control panel 217, an image start sensor 218, an image end sensor 219, a main scanning direction motor 221, a sub-scanning direction motor 231, a sheet input motor 241, a switching board solenoid 251, and a branch board solenoid 261.

The controller 200 includes a CPU 201, a ROM 202, a RAM 203, a nonvolatile memory (NVRAM) 204, an ASIC 205, a scanner controller 206, an external I/F 207, a head drive controller 208, a head driver 209, a bus 210, a motor driver 211, a motor driver 212, a motor driver 213, solenoid drivers 214, a high voltage circuit 215, and an I/O 216.

The controller 200 is configured to control operations of the image forming apparatus. The control panel 217 is configured to be connected with the controller 200, and input and display information necessary to operate the image forming apparatus. The image start sensor 218 is configured to detect a foremost edge of the sheet 5 on an upstream side in the sheet conveyance direction. The image end sensor 219 is configured to detect a tail edge of the sheet 5 on a downstream side in the sheet conveyance direction. The main scanning direction motor 221 is configured to move the carriage 23 in the main scanning direction. The sub-scanning direction motor 231 is configured to cause the rotating conveyance roller 32 to rotate the conveyance belt 31. The sheet input motor 241 is configured to drive a motor relating to input of the sheet 5. The switching board solenoid 251 is configured to cause the switching board 96 to pivot to switch between the conveyance path for feeding the sheet 5 from the horizontal conveyance route 90*a* to the switchback conveyance route 90*b* and the conveyance path for feeding back the sheet 5 from the switchback conveyance route 90*b* to the conveyance roller pair 48. The branch board solenoid 261 is configured to cause the branch mechanism 100 to switch the conveyance path to the duplex conveyance path 90.

The CPU 201 is configured to control operations of the entire image forming apparatus, and communicates through the bus 210 with the ROM 202, RAM 203, NVRAM 204, ASIC 205, scanner controller 206, external I/F 207, head drive controller 208, motor drivers 211-213, solenoid driver 214, high voltage circuit 215 and I/O 216, as well as control panel 217. The ROM 202 is configured to store a program run by the CPU 201 and other fixed data. The RAM 203 is configured to temporarily store image data or the like. The nonvolatile memory (NVRAM) 204 is configured to retain data while a power source (not shown) of the image forming apparatus is turned off. The ASIC 205 is configured to process various signals for the image data, and input and output signals for performing image processing such as sorting, and controlling the entire image forming apparatus. The scanner controller 206 is configured to scan an image by using the image reader 11 and performing data processing for the scanned image. The external I/F 207 is configured to send and receive data and a signal used to receive data from an external device. The head drive controller 208 and the head driver 209 are configured to drive and control the recording head 24. The motor driver 211 is configured to drive the main scanning direction motor 221. The motor driver 212 is configured to drive the sub-scanning direction motor 231. The motor driver 213 is configured to drive a motor relating to input and output of the sheet 5 such as the sheet input motor 241, a sheet output motor (not shown), or a duplex conveyance motor (not shown). The solenoid drivers 214 are configured to drive the switching board solenoid 251, the branch board solenoid 261, and clutches including a paper tray electromagnetic clutch (not shown) which drives and rotates the paper tray roller 42. The high voltage circuit 215 is configured to apply a high voltage on the charging roller 34. The I/O 216 is configured to input a detection signal sent from the image start sensor 218 and the image end sensor 219.

If the image reader 11 scans an image on the original, the controller 200 processes the scanned image data, and then stores the processed image data into a buffer provided in the scanner controller 206. If the controller 200 receives via the external I/F 207 image data or the like from an external host including an information processing device such as a personal computer, an image scanning device such as an image scanner, or an imaging device such as a digital camera, the controller 200 stores the image data or the like into a receive buffer included in the external I/F 207.

The CPU 201 reads the image data sent from the scanner controller 206 and the external I/F 207 and analyzes the read image data. The ASIC 205 performs necessary image processing and data sorting, and then transfers the image data to the head drive controller 208. To generate dot pattern data for outputting image data based on data input from the external host, for example, the ROM 202 may store font data or a printer driver installed in the external host may convert the image data into bitmap data and transfer the bitmap data to the image forming apparatus.

When the head drive controller 208 receives the image data (i.e., the dot pattern data) equivalent to one line created by each recording head 24, the head drive controller 208 transfers the dot pattern data for the one line to the head driver 209. The head driver 209 drives the actuator of the recording head 24 to selectively apply a required drive waveform based on the dot pattern data. Thus, the nozzle of the required recording head 24 discharges a liquid drop.

In the image forming apparatus configured as described above, the sheet 5 is fed one by one from the paper tray 4 or the duplex unit 10. The pressure roller 36 presses the sheet 5 onto the conveyance belt 31 and a conveyance direction of the sheet 5 is turned by approximately 90 degrees. When the sheet 5 is fed from the bypass tray 46, the pressure roller 36 also presses the sheet 5 onto the conveyance belt 31. The sheet 5 is electrostatically attracted to the conveyance belt 31, and conveyed in the sub-scanning direction as the conveyance belt 31 rotates.

The controller 200 drives the recording head 24 in accordance with an image signal while moving the carriage 23. Therefore, the nozzle discharges an ink drop onto the stopped sheet 5 to perform recording for one line. When recording for one line has finished, the sheet 5 is fed by a length of one line, and then recording for a next one line is performed. Thus, the sheet 5 is periodically fed so that an image is formed on the sheet 5. When the controller 200 receives a signal indicating that recording has finished or a signal indicating that the tail edge of the sheet 5 has passed a recording area, recording stops and the sheet 5 is fed onto any one of the output tray 8, the duplex unit 10, and the straight output tray 67.

A structure of the branch mechanism 100 is explained with reference to FIGS. 4 to 6.

Figure 4:
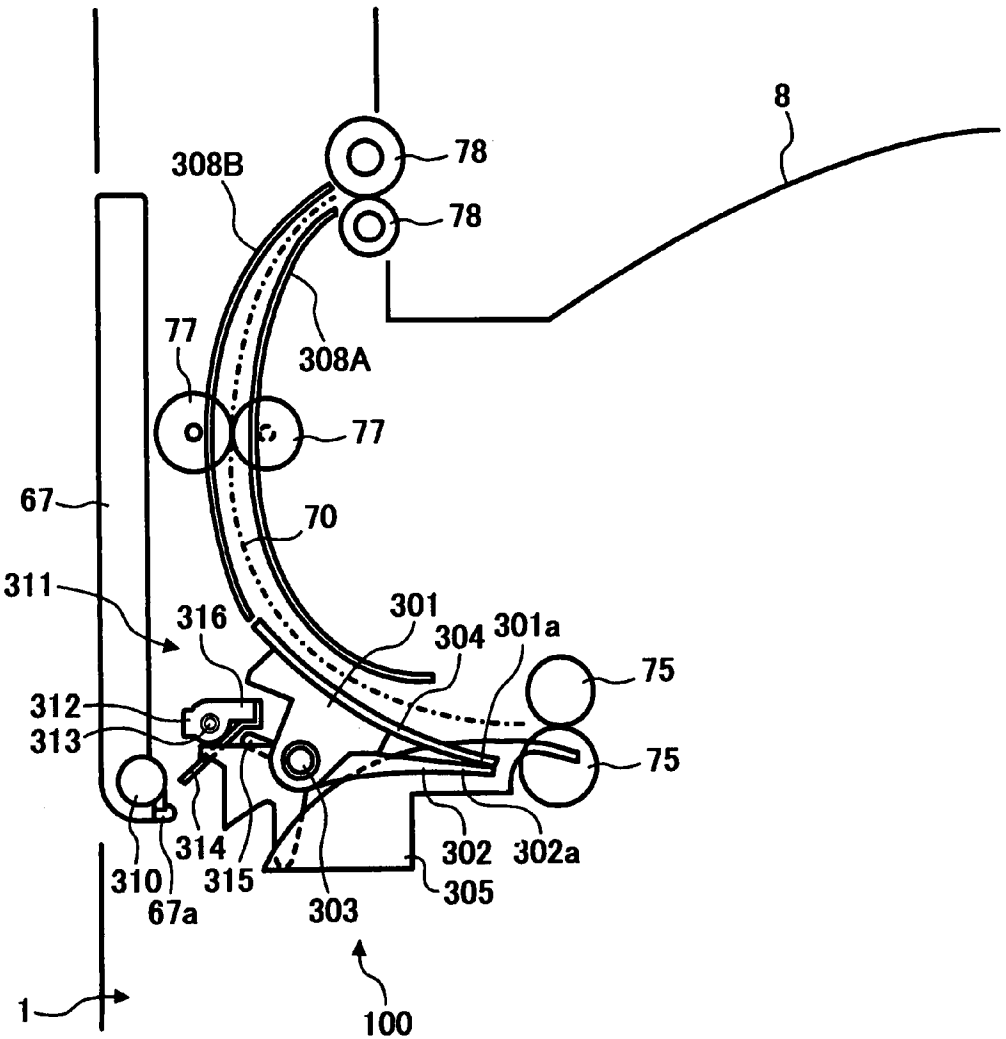
FIG. 4 is an illustration showing a state in which a branch mechanism of the image forming apparatus of FIG. 1 switches to a reverse conveyance path.

FIG. 4 is an illustration showing a state in which the branch mechanism 100 switches to the reverse conveyance path 70. FIG. 5 is an illustration showing a state in which the branch mechanism 100 switches to the straight conveyance path 80. FIG. 6 is an illustration showing a state in which the branch mechanism 100 switches to the duplex conveyance path 90.

Figure 5:
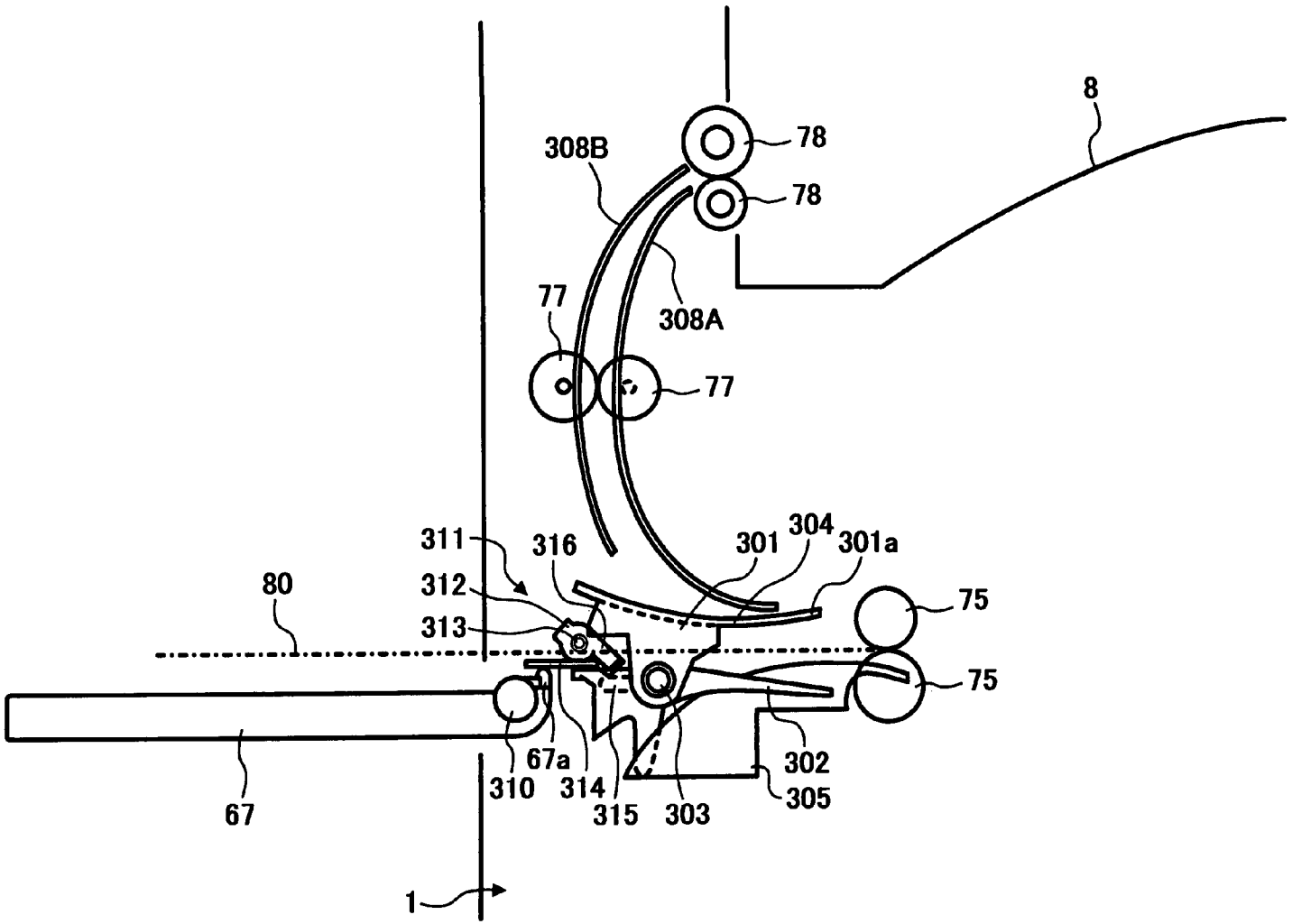
FIG. 5 is an illustration showing a state in which the branch mechanism of the image forming apparatus of FIG. 1 switches to a straight conveyance path.
Figure 6:
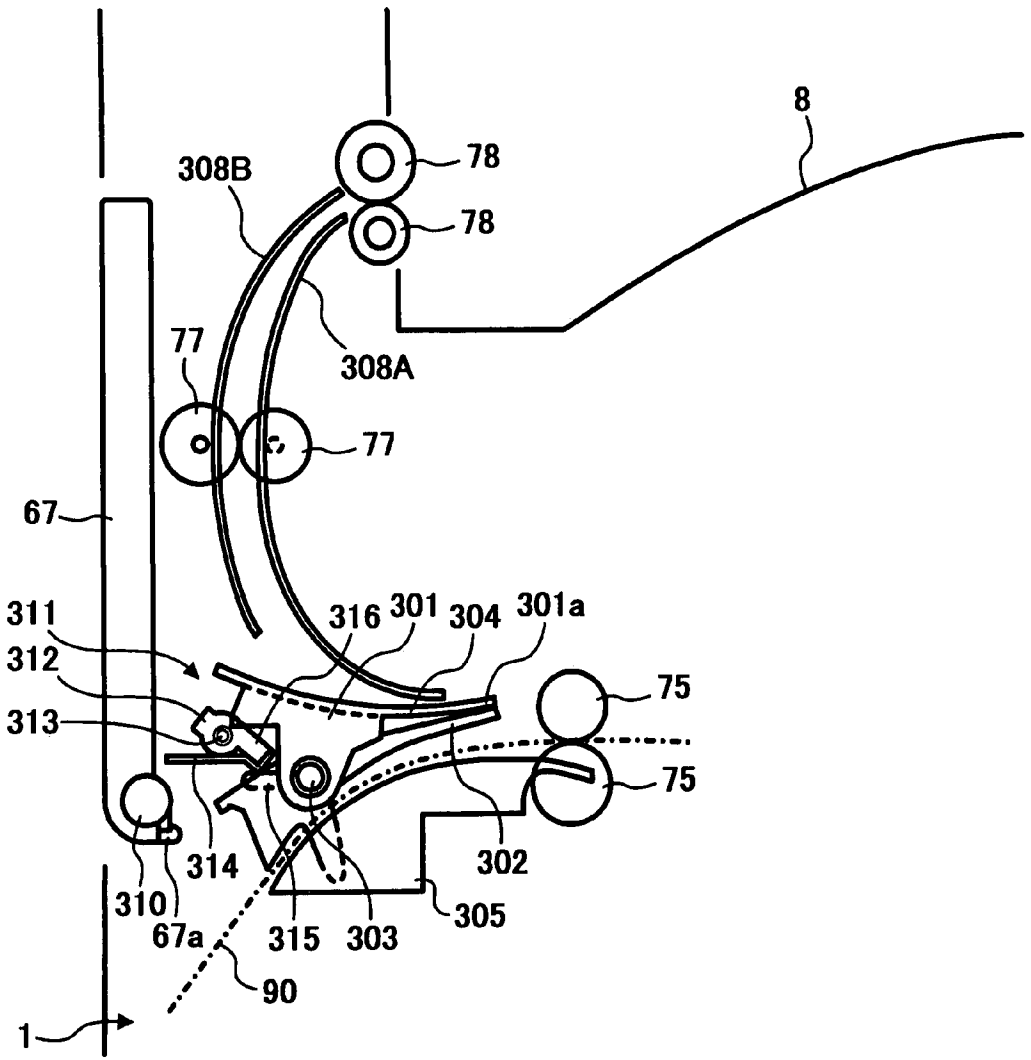
FIG. 6 is an illustration showing a state in which the branch mechanism of the image forming apparatus of FIG. 1 switches to a duplex conveyance path.

As illustrated in FIGS. 4 to 6, the branch mechanism 100 includes a first branch board 301, a second branch board 302, a support axis 303, a movable reverse guide board 304, a guide board 305, guide boards 308A and 308B, a support axis 310, and an interlock mechanism 311.

The first branch board 301 includes a foremost edge portion 301*a*. The second branch board 302 includes a foremost edge portion 302*a*. The interlock mechanism 311 includes a swing member 312, an axis 313, a link piece 314, a protruding portion 315, and an arm 316. The straight output tray 67 includes a bottom edge portion 67*a*.

The first branch board 301 and the second branch board 302 are configured to swing to open any one of the reverse conveyance path 70, the straight conveyance path 80, and the duplex conveyance path 90. The support axis 303 is configured to be arranged on the second branch board 302 and support the first branch board 301 in a manner that the first branch board 301 can swing. The movable reverse guide board 304 is configured to form the reverse conveyance path 70. The guide board 305 is configured to be arranged below the second branch board 302 and guide the sheet 5 fed by the fed sheet conveyance roller pair 75 to the duplex conveyance path 90. The guide boards 308A and 308B are configured to form the reverse conveyance path 70 together with the first branch board 301. The support axis 310 is configured to support the straight output tray 67 to a frame of the body 1 in a manner that the straight output tray 67 can be opened. The interlock mechanism 311 is configured to be arranged between the straight output tray 67 and the first branch board 301, and interlock the straight output tray 67 with the first branch board 301.

The foremost edge portion 301*a* is configured to contact the foremost edge portion 302*a* so that the first brand board 301 and the second branch board 302 simultaneously swing. The foremost edge portion 302*a* is configured to contact the foremost edge portion 301*a* so that the first brand board 301 and the second branch board 302 simultaneously swing. The swing member 312 is configured to swing to interlock the straight output tray 67 with the first branch board 301. The axis 313 is configured to support the swing member 312 in a manner that the swing member 312 can swing. The link piece 314 is configured to be attached to the swing member 312 and link the straight output tray 67 with the interlock mechanism 311. The protruding portion 315 is configured to be integrally provided with the first branch board 301 and engaged with the arm 316. The arm 316 is configured to be integrally provided with the swing member 312 and engaged with the protruding portion 315. The bottom edge portion 67*a* is configured to contact the link piece 34 when the straight output tray 67 is opened.

The first branch board 301 and the second branch board 302 are arranged at a position where the recording liquid dries, which is discharged by the image forming unit 2 onto the sheet 5 so that an image is formed on the sheet 5. The position where the recording liquid on the sheet 5 dries, that is, a position where the branch mechanism 100 is arranged, may be determined based on a conveyance speed of the sheet 5 and a conveyance distance to the branch mechanism 100. Thus, it is possible to prevent the surface of the sheet 5 on which an image is formed from contacting the first branch board 301 or the second branch board 302 and being scratched before the recording liquid on the sheet 5 dries, and to prevent the image from deteriorating.

The first branch board 301 integrally forms a movable reverse guide board 304. The support axis 303 supports the first branch board 301 in a manner that the first branch board 301 can swing. A top surface of the second branch board 302 forms a guide surface for the straight conveyance path 80. A bottom surface of the second branch board 302 forms a guide surface for the duplex conveyance path 90. The frame of the body 1 supports the second branch board 302 at a same position as the support axis 303 in a manner that the second branch board 302 can swing.

The first branch board 301 and the second branch board 302 have a same axis for swinging. As illustrated in FIG. 4, the second branch board 302 supports the first branch board 301 in a manner that the first branch board 301 can swing. Sides of the first branch board 301 and the second branch board 302 form a clothespin-like shape.

The first branch board 301 and the second branch board 302 are respectively arranged above and below the straight conveyance path 80, so that the straight conveyance path 80 is formed between the first branch board 301 and the second branch board 302. As illustrated in FIG. 4, a spring (not shown) applies a force to keep the first branch board 301 and the second branch board 302 in a state in which the reverse conveyance path 70 is opened in an initial state.

The guide board 305 is arranged below the second branch board 302. The guide boards 308A and 308B form the reverse conveyance path 70 together with the first branch board 301.

The interlock mechanism 311 is arranged between the straight output tray 67 and the first branch board 301.

The swing member 312 is arranged between a bottom edge portion 67*a* and the first branch board 301. The swing member 312 does not interconnect the straight output tray 67 with the first branch board 301.

The link piece 314 is formed of an elastic member such as a plate spring. Only when the straight output tray 67 is opened to an open position as illustrated in FIG. 5, the link piece 314 contacts the bottom edge portion 67*a* and is pushed upward.

The branch board solenoid 261 swings the second branch board 302. When the branch board solenoid 261 is driven, the second branch board 302 swings from a position as illustrated in FIG. 4 to a position as illustrated in FIG. 6. Namely, the foremost edge portion 302*a* contacts the foremost edge portion 301*a*. Thus, the first branch board 301 simultaneously swings to the position as illustrated in FIG. 6 as the second branch board 302 swings. The foremost edge portion 302*a* contacts the foremost edge portion 301*a* in the initial state.

Operations of the branch mechanism 100 for one-sided printing are explained with reference to FIG. 7.

Figure 7:
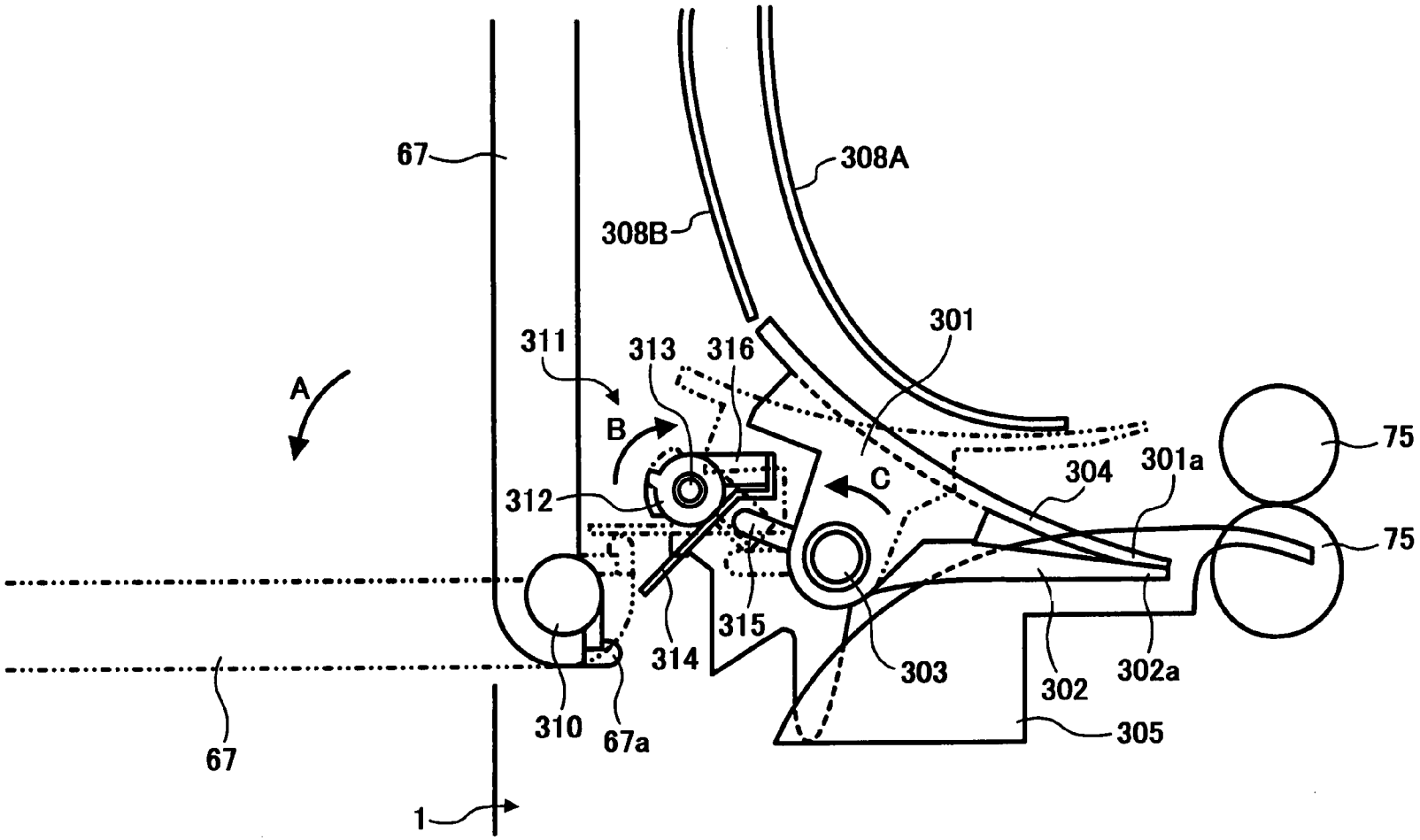
FIG. 7 is an enlarged view for explaining operations for switching between the reverse conveyance path and the straight conveyance path in the branch mechanism of the image forming apparatus of FIG. 1.

FIG. 7 is an enlarged view for explaining operations for switching between the reverse conveyance path 70 and the straight conveyance path 80.

In the initial state, the straight output tray 67 is stored in the body 1 as illustrated with a solid line in FIG. 7. In this state, the movable reverse guide board 304 is positioned to form a guide portion of the reverse conveyance path 70. Therefore, when the fed sheet conveyance roller pair 75 feeds the sheet 5 on which an image is formed, the movable reverse guide board 304 guides the sheet 5 to the reverse conveyance path 70. Then, the sheet reverse roller pair 77 and the reversed sheet feeding roller pair 78 feed the sheet 5 onto the output tray 8.

When the straight output tray 67 in a stored state as illustrated with the solid line in FIG. 7 is opened in a direction shown by an arrow A to a position as illustrated with a broken line in FIG. 7, the bottom edge portion 67*a* engages with one edge portion of the link piece 314 and pushes the edge portion upward. The swing member 312 rotates in a direction shown with an arrow B. The arm 316 engages with the protruding portion 315 and pushes down the protruding portion 315. Thus, the first branch board 301 rotates (i.e., swings) in a direction shown with an arrow C.

As illustrated with the broken line in FIG. 7, the foremost edge portion 301*a* moves up to a position above an exit of the fed sheet conveyance roller pair 75. The second branch board 302 is kept at a position as illustrated in FIG. 7 unless the branch board solenoid 261 is driven. Thus, the foremost edge portion 301*a* and the foremost edge portion 302*a* separate to open an entrance of the straight conveyance path 80.

Therefore, the sheet 5 fed by the fed sheet conveyance roller pair 75 can be straight conveyed. The sheet 5 is fed onto the straight output tray 67 through the straight conveyance path 80.

When the straight output tray 67 is closed to a storage position as illustrated with the solid line in FIG. 7, movements in directions reverse to those as described above move back the first branch board 301 via the interlock mechanism 311. The foremost edge portion 301*a* moves down to a position below the exit of the fed sheet conveyance roller pair 75. Thus, the reverse conveyance path 70 is opened and the straight conveyance path 80 is closed.

When the straight output tray 67 is closed, the sheet 5 on which an image is formed passes through the fed sheet conveyance roller pair 75, is guided by the movable reverse guide board 304, is conveyed through the reverse conveyance path 70, and then is fed onto the output tray 8 face down.

As illustrated with the broken line in FIG. 7, when the straight output tray 67 is opened, the sheet 5 on which an image is formed is fed by the fed sheet conveyance roller pair 75, conveyed through the straight conveyance path 80 which is formed below the movable reverse guide board 304 and above the second branch board 302, and then fed onto the straight output tray 67 face up.

The image forming apparatus having both the reverse conveyance path 70 and the straight conveyance path 80 can occupy less space, and handle sheets such as an OHP transparency on which it takes longer before the recording liquid dries and thick paper which is not easily reversed.

Further, in the image forming apparatus configured to switch between the reverse conveyance path 70 and the straight conveyance path 80 in accordance with the movement of the straight output tray 67, the conveyance path can be automatically switched by operating only the straight output tray 67, resulting in improvement in user-friendliness.

The interlock mechanism 311 interlocks the straight output tray 67 and the first branch board 301 by using the swing member 312 which does not interconnect the straight output tray 67 with the first branch board 301. Therefore, the straight output tray 67, the first branch board 301, and the swing member 312 do not bite with each other, resulting in reduced malfunctions. Further, the interlock mechanism 311 is formed of the elastic member such as the plate spring (i.e., the link piece 314). Therefore, deformation of the elastic member can reduce bites and the like with more certainty and secure stable switching operations for a long time.

Operations of the branch mechanism 100 for duplex printing are explained with reference to FIGS. 8 and 9.

Figure 8:
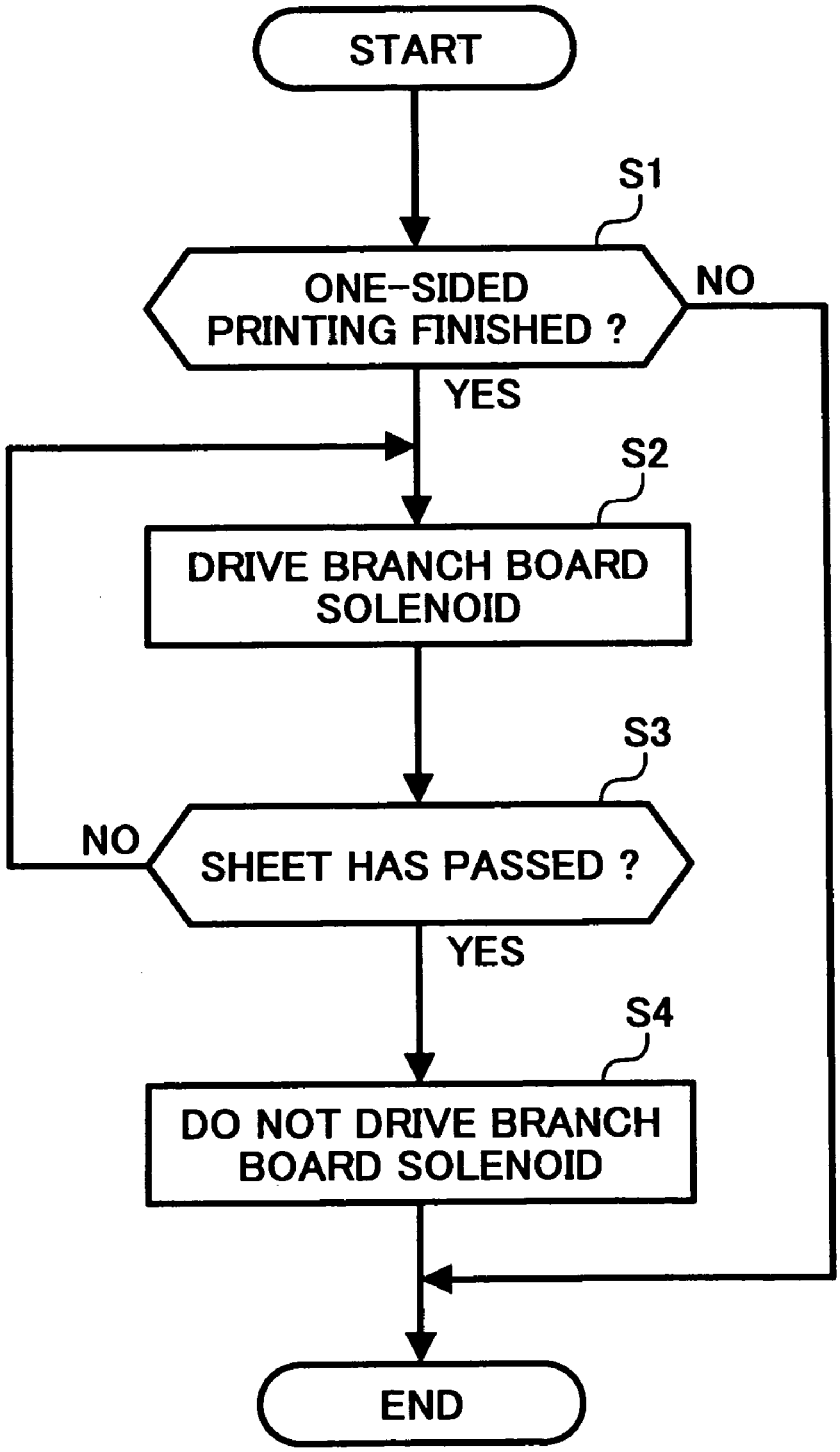
FIG. 8 is a flowchart for explaining operations for switching to the duplex conveyance path in the branch mechanism of the image forming apparatus of FIG. 1.

FIG. 8 is a flowchart for explaining operations for switching to the duplex conveyance path 90. FIG. 9 is an enlarged view for explaining operations for switching to the duplex conveyance path 90.

Figure 9:
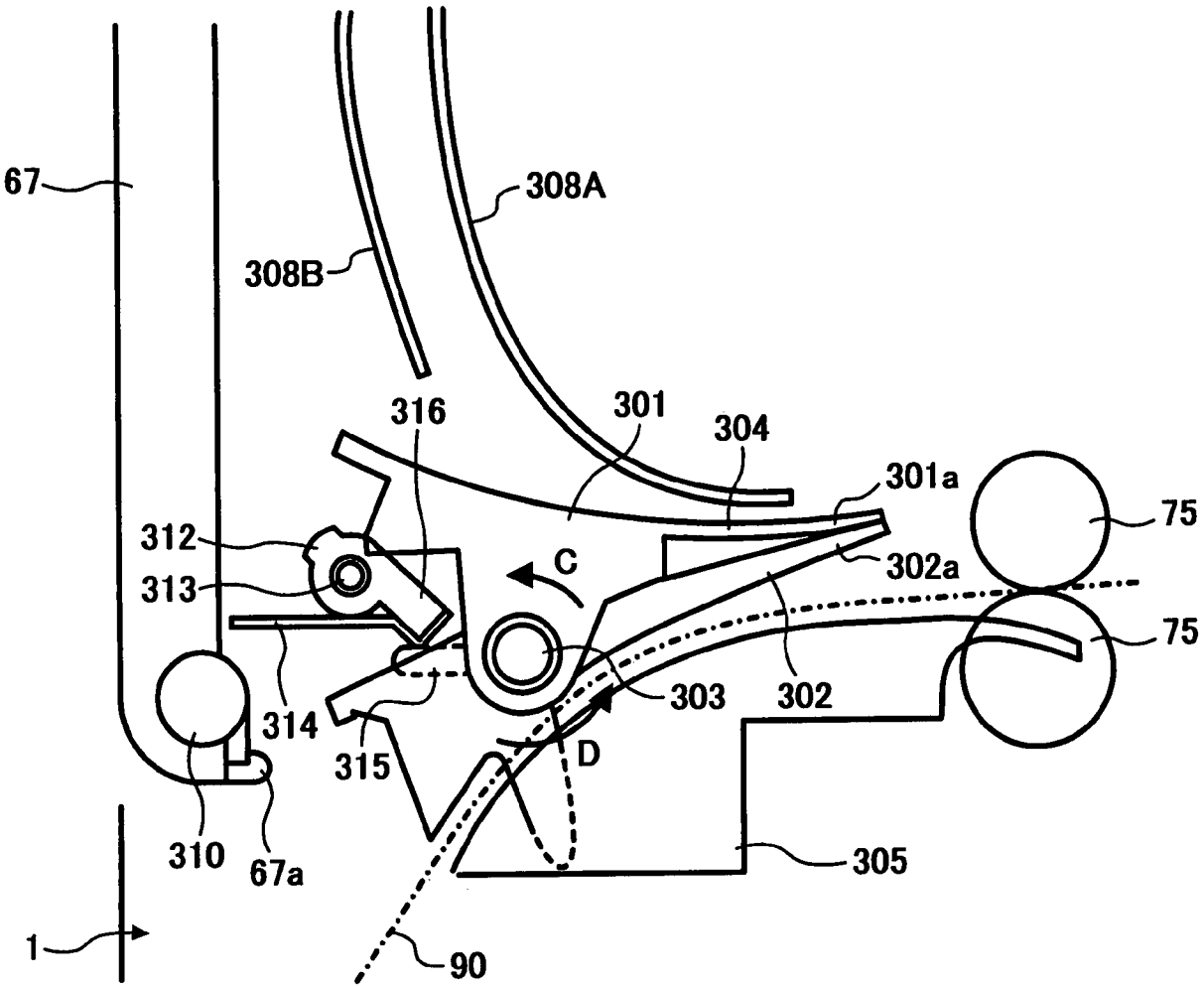
FIG. 9 is an enlarged view for explaining operations for switching to the duplex conveyance path in the branch mechanism of the image forming apparatus of FIG. 1.

After an image is formed on one side of the sheet 5 (Step S1 in FIG. 8), the branch board solenoid 261 is driven to swing the second branch board 302 in a direction shown with an arrow D as illustrated in FIG. 9 (Step S2 in FIG. 8), so that the foremost edge portion 302*a* is positioned above the exit of the fed sheet conveyance roller pair 75.

The first branch board 301 is pushed up and simultaneously swings in the direction shown with the arrow C as the second branch board 302 swings. Thus, the duplex conveyance path 90 between the second branch board 302 and the guide board 305 is opened. Namely, the first branch board 301 is not interconnected with the straight output tray 67. Therefore, the first branch board 301 can simultaneously swing as the second branch board 302 swings if a force resisting a pressing force such as a spring is applied. Thus, even if the solenoid drivers 214 for driving the first branch board 301 and the second branch board 302 are not simultaneously driven, the first branch board 301 and the second branch board 302 can swing to open the duplex conveyance path 90.

The fed sheet conveyance roller pair 75 feeds the sheet 5 on one side of which an image is formed through the duplex conveyance path 90 into the duplex unit 10. Then, the sheet 5 is switched back and fed back as described above.

At timing when the sheet 5 on one side of which an image is formed has passed the branch mechanism 100 (Step S3 in FIG. 8), the branch board solenoid 261 is not driven (Step S4 in FIG. 8). The timing may be detected with a sensor or measured on a time basis. The second branch board 302 and the first branch board 301 accordingly return to the positions shown with the solid lines as illustrated in FIG. 7. Thus, the reverse conveyance path 70 is opened.

Therefore, the fed sheet conveyance roller pair 75 feeds the sheet 5 on the other side of which an image is formed (i.e., the sheet 5 on which duplex printing is performed) through the reverse conveyance path 70 onto the output tray 8.

The first branch board 301 and the second branch board 302 are arranged to sandwich the straight conveyance path 80 in a manner that the first branch board 301 and the second branch board 302 can swing. One of the first branch board 301 and the second branch board 302 independently swings or the first branch board 301 and the second branch board 302 simultaneously swing to switch the conveyance path to any one of the reverse conveyance path 70, the straight conveyance path 80, and the duplex conveyance path 90. Thus, the simple structure and operations enable switching among the reverse conveyance path 70, the straight conveyance path 80, and the duplex conveyance path 90. Further, even if the reverse conveyance path 70 frequently used is always opened, switching operations can be performed without operating the solenoid drivers 214 for driving both the first branch board 301 and the second branch board 302 as in a case of the conventional image forming apparatus to perform duplex printing.

Viewing as a structure of the sheet conveying apparatus, to switch the conveyance path of the sheet 5 among the first, second, and third conveyance paths, the second conveyance path is arranged between the first branch board 301 and the second branch board 302 in a manner that the first branch board 301 and the second branch board 302 can swing. Independently swinging one of the first branch board 301 and the second branch board 302 enables switching to any one of the first conveyance path and the second conveyance path. Simultaneously swinging the first branch board 301 and the second branch board 302 enables switching to the third conveyance path. Thus, the simple structure and operations enable switching among the reverse conveyance path 70, the straight conveyance path 80, and the duplex conveyance path 90.

A structure of the branch mechanism 100 according to another embodiment of this disclosure is explained with reference to FIGS. 10 to 12.

Figure 10:
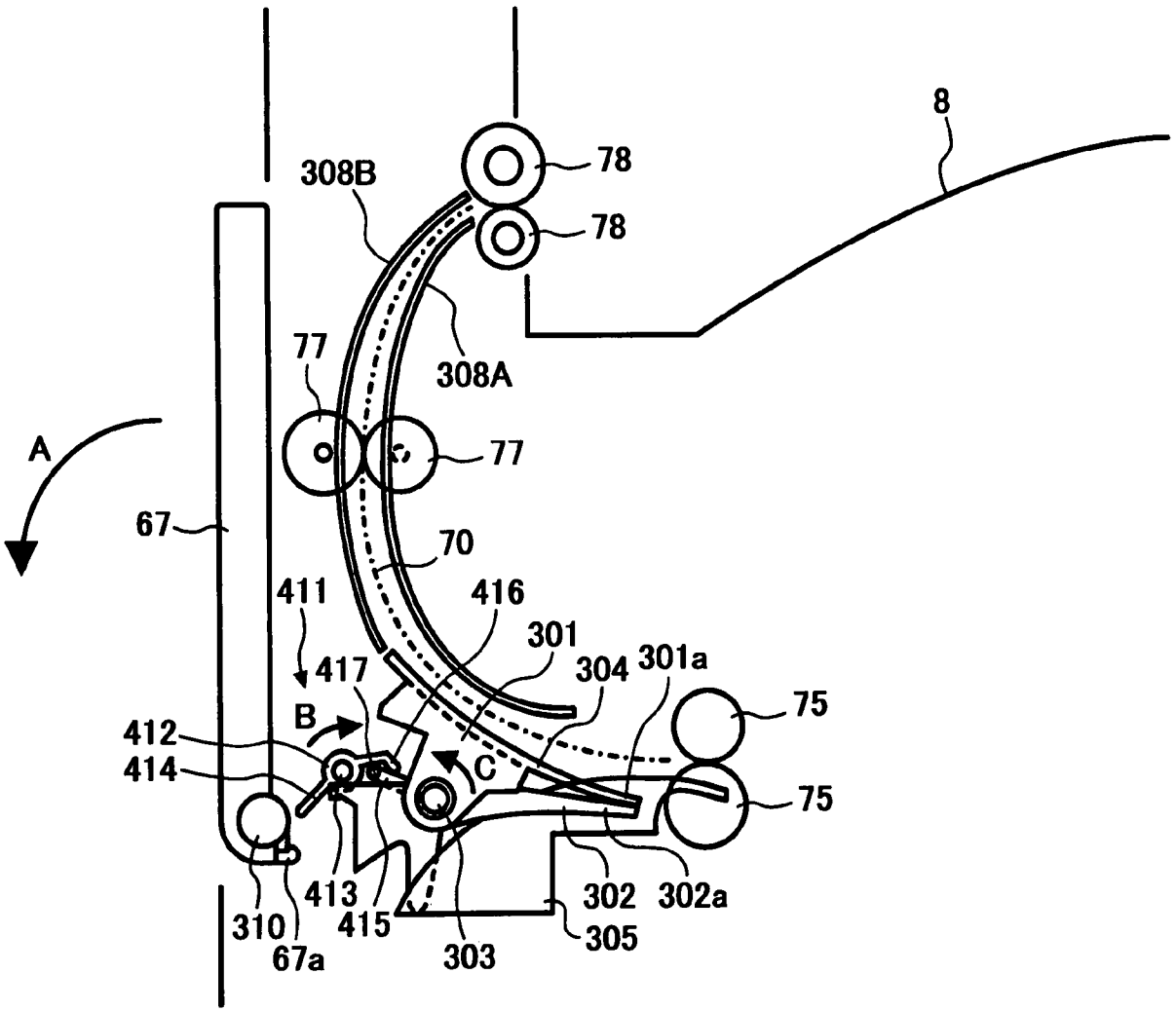
FIG. 10 is an illustration showing a state in which a branch mechanism according to another embodiment of this disclosure switches to the reverse conveyance path.

FIG. 10 is an illustration showing a state in which the conveyance path switches to the reverse conveyance path 70. FIG. 11 is an illustration showing a state in which the conveyance path switches to the straight conveyance path 80. FIG. 12 is an illustration showing a state in which the conveyance path switches to the duplex conveyance path 90.

Figure 11:
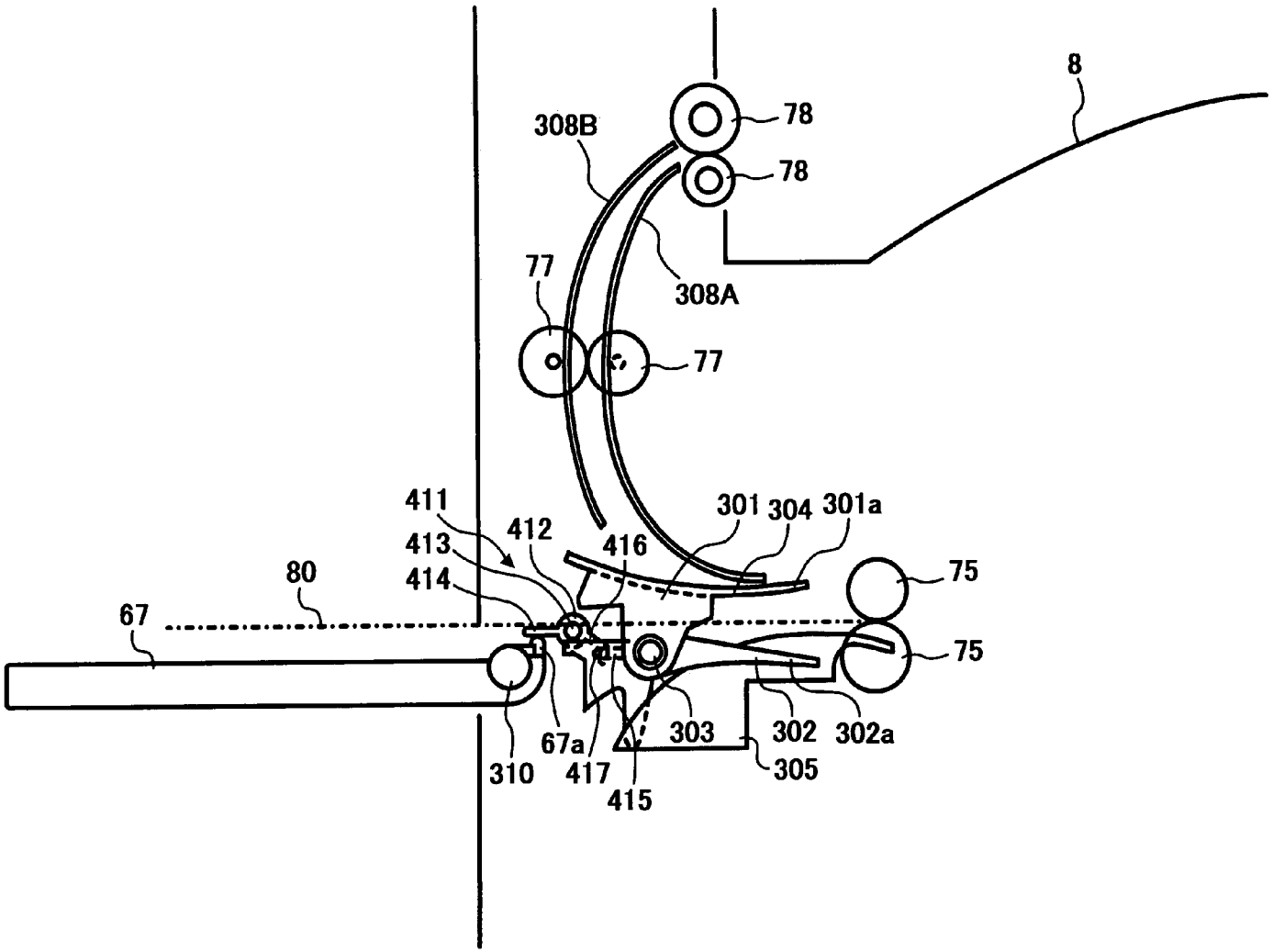
FIG. 11 is an illustration showing a state in which the branch mechanism of FIG. 10 switches to the straight conveyance path.
Figure 12:
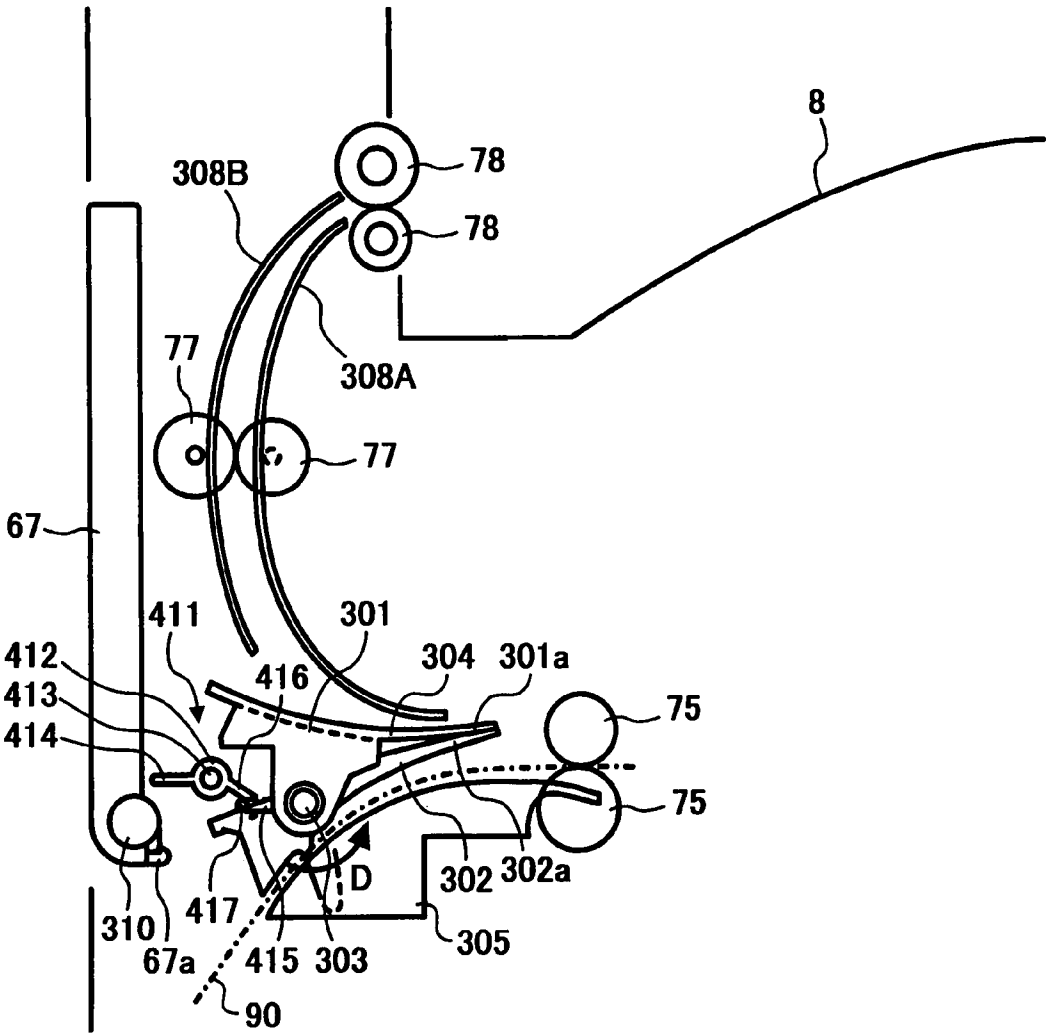
FIG. 12 is an illustration showing a state in which the branch mechanism of FIG. 10 switches to the duplex conveyance path.

According to the present embodiment, as illustrated in FIGS. 10 to 12, an interlock mechanism 411 replaces the interlock mechanism 311. A swing member 412 replaces the swing member 312. An axis 413 replaces the axis 313. A link piece 414 replaces the link piece 314. A protruding portion 415 replaces the protruding portion 315. An arm 416 replaces the arm 316. The interlock mechanism 411 includes a pin 417.

The interlock mechanism 411 is configured to be arranged between the straight output tray 67 and the first branch board 301 and interlock the straight output tray 67 with the first branch board 301. The swing member 412 is configured to swing to interlock the straight output tray 67 with the first branch board 301. The axis 413 is configured to support the swing member 412 in a manner that the swing member 412 can swing. The link piece 414 is configured to be attached to the swing member 412 and link the straight output tray 67 with the interlock mechanism 411. The protruding portion 415 is configured to be integrally provided with the first branch board 301 and engaged with the arm 416. The arm 416 is configured to be integrally provided with the swing member 412 and engaged with the pin 417 implanted in the protruding portion 415. The pin 417 is configured to be implanted in the protruding portion 415 and engaged with the arm 416.

The swing member 412 is arranged between the bottom edge portion 67*a* and the first branch board 301. The swing member 412 does not interconnect the straight output tray 67 with the first branch board 301.

Only when the straight output tray 67 is opened to the open position as illustrated in FIG. 11, the link piece 414 contacts the bottom edge portion 67*a* and is pushed upward.

When the straight output tray 67 in the stored state as illustrated with a solid line in FIG. 10 is opened in the direction shown by the arrow A to the open position as illustrated in FIG. 11, the bottom edge portion 67*a* engages with one edge portion of the link piece 414 and pushes the edge portion upward as illustrated in FIG. 11. The swing member 412 rotates in the direction shown with the arrow B as illustrated in FIG. 10. The arm 416 engages with the pin 417 and pushes down the pin 417. Thus, the first branch board 301 rotates in the direction shown with the arrow C as illustrated in FIG. 10.

As illustrated in FIG. 11, the foremost edge portion 301*a* moves up to the position above the exit of the fed sheet conveyance roller pair 75. The straight conveyance path 80 is opened so that the sheet 5 fed by the fed sheet conveyance roller pair 75 can be straight conveyed. Thus, the conveyance path is switched from the reverse conveyance path 70 to the straight conveyance path 80.

When the straight output tray 67 is closed to the storage position as illustrated in FIG. 10, movements in directions reverse to those as described above move back the first branch board 301 via the interlock mechanism 411. The foremost edge portion 301*a* moves down to the position below the exit of the fed sheet conveyance roller pair 75. Thus, the reverse conveyance path 70 is opened and the straight conveyance path 80 is closed.

As illustrated in FIG. 10, when the straight output tray 67 is closed, the sheet 5 on which an image is formed passes through the fed sheet conveyance roller pair 75, is guided by the movable reverse guide board 304, is conveyed through the reverse conveyance path 70 by the sheet reverse roller pair 77, and then is fed by the reversed sheet feeding roller pair 78 onto the output tray 8 face down.

As illustrated in FIG. 11, when the straight output tray 67 is opened, the sheet 5 on which an image is formed is fed by the fed sheet conveyance roller pair 75, conveyed through the straight conveyance path 80, and then fed onto the straight output tray 67 face up.

According to the present embodiment, the swing member 412 does not include an elastic member such as a spring. However, if the swing member 412 is formed of a material having a certain level of elasticity such as a resin, effects similar to those according to the previous embodiment can be obtained.

To perform duplex printing, as is according to the previous embodiment, the branch board solenoid 261 is driven to swing the second branch board 302 in a direction shown with the arrow D as illustrated in FIG. 12, so that the duplex conveyance path 90 is opened.

Even in the above configuration, simple operations of independently or simultaneously swinging the first branch board 301 and the second branch board 302 enable switching among the reverse conveyance path 70, the straight conveyance path 80, and the duplex conveyance path 90 in a manner similar to that according to the previous embodiment.

According to the above embodiments, this disclosure is applied to the image forming apparatus including the liquid drop discharging head. However, this disclosure can also be applied to the image forming apparatus including an image forming unit using an electrophotographic method.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application, No. 2004-141258 filed on May 11, 2004, in the Japan Patent Office, the entire contents of which are incorporated by reference herein.

What is claimed is:

1. An image forming apparatus, comprising:

a reverse conveyance path configured to output a recording sheet face down;

a straight conveyance path configured to straight output a recording sheet face up;

a duplex conveyance path configured to output a recording sheet on both sides of which images are formed;

a straight output tray configured to receive sheets fed through said straight conveyance path;

a first branch board interlocked with the straight output tray and configured to independently swing to switch to any one of the reverse conveyance path and the straight conveyance path;

a second branch board configured to sandwich, together with the first branch board, the straight conveyance path; and a branch mechanism configured to swing the first and second branch boards simultaneously to switch to the duplex conveyance path.

2. The image forming apparatus of claim 1, wherein one of the first and second branch boards is rotatably supported by the other of the first and second branch boards.

3. The image forming apparatus of claim 1, wherein the straight output tray swings the first branch board when the straight output tray is opened.

4. The image forming apparatus of claim 3, further comprising:

a swing member separately provided from the straight output tray and the first branch board and configured to be contacted and swung upward by the straight output tray when the straight output tray is opened, so as to engage with the first branch board to move the first branch board.

5. The image forming apparatus of claim 4, wherein the swing member includes an elastic member.

6. The image forming apparatus of claim 1, further comprising:

an image forming unit configured to form an image on a recording sheet, the image forming unit including a liquid drop discharging head configured to discharge a liquid drop of recording liquid.

7. The image forming apparatus of claim 6, wherein the first and second branch boards are arranged near a downstream end of the straight conveyance path in a sheet conveyance direction inside the image forming apparatus.

8. A sheet conveying apparatus, comprising:

a first conveyance path configured to output a recording sheet face down;

a second conveyance path configured to output a recording sheet face up;

a third conveyance path configured to output a recording sheet on both sides of which images are formed;

a straight output tray configured to receive sheets fed through said second conveyance path;

a first branch board interlocked with the straight output tray and configured to independently swing to switch to any one of the first conveyance path and the second conveyance path;

a second branch board configured to sandwich, together with the first branch board, the second conveyance path; and a branch mechanism configured to swing the first and second branch boards simultaneously switch to the third conveyance path.

9. The sheet conveying apparatus of claim 8, wherein the first and second branch boards are arranged in a manner that the first and second branch boards have a same axis for swinging.

10. The sheet conveying apparatus of claim 8.

wherein the first and second branch boards are rotatably connected with each other.

11. The sheet conveying apparatus of claim 8, wherein one of the first second branch boards is rotatably supported by the other of the first and second branch boards.

12. An image forming apparatus, comprising:

reverse conveyance means for outputting a recording sheet face down;

straight conveyance means for straight outputting a recording sheet face up;

duplex conveyance means for outputting a recording sheet on both sides of which images are formed;

straight output means for receiving sheets fed through said straight conveyance means;

first branch means interlocked with the straight output means, for independently swinging to switch to any one of the reverse conveyance means and the straight conveyance means;

second branch means for sandwiching, together with the first branch means, the straight conveyance means; and a branch mechanism for swinging the first and second branch means simultaneously to switch to the duplex conveyance means.

13. The image forming apparatus of claim 12, wherein one of the first and second branch means is rotatably supported by the other of the first and second branch means.

14. The image forming apparatus of claim 12, wherein the straight output means swings the first branch means when the straight output means is opened.

15. The image forming apparatus of claim 14, further comprising:

swing means separately provided from the straight output means and the first branch means and to be contacted and swung upward by the straight output means when the straight output means is opened, so as to engage with the first branch means to move the first branch means.

16. The image forming apparatus of claim 15, wherein the swing means includes an elastic member.

17. The image forming apparatus of claim 12, further comprising:

image forming means for forming an image on a recording sheet, the image forming means including liquid drop discharging means for discharging a liquid drop of recording liquid.

18. The image forming apparatus of claim 17, wherein the first and second branch means are arranged near a downstream end of the straight conveyance means in a sheet conveyance direction inside the image forming apparatus.

19. A sheet conveying apparatus, comprising:

first conveyance means for outputting a recording sheet face down;

second conveyance means for outputting a recording sheet face up;

third conveyance means for outputting a recording sheet on both sides of which images are formed;

straight output means for receiving sheets fed through said second conveyance means;

first branch means interlocked with the straight output means, for independently swinging to switch to any one of the first conveyance means and the second conveyance means;

second branch means for sandwiching, together with the first branch means, the second conveyance means; and a branch mechanism for swinging the first and second branch means simultaneously to switch to the third conveyance means.

20. The sheet conveying apparatus of claim 19, wherein the first and second branch means are arranged in a manner that the first and second branch means have a same axis for swinging.

21. The sheet conveying apparatus of claim 19, wherein the first and second branch means are rotatably connected with each other.

22. The sheer conveying apparatus of claim 19, wherein one of the first and second branch means is rotatably supported by the other of the first and second branch means.

23. A method for image forming, comprising:

providing a reverse conveyance path for outputting a recording sheet face down, a straight conveyance path for outputting a recording sheet face up, and a duplex conveyance path for outputting a recording sheet on both sides of which images are formed;

providing a straight output tray to receive sheets fed through the straight conveyance path;

providing a first branch board interlocked with the straight output tray and configured to independently swing to switch to any one of the reverse conveyance path and the straight conveyance path;

providing a second branch board configured to sandwich, together with the first branch board, the straight conveyance path;

conveying a recording sheet with an image by an image forming unit; and swinging the first and second branch boards simultaneously to switch to the duplex conveyance path.

24. The meted of claim 23, wherein one of the first and second branch boards is rotatably supported by the other of the first and second branch boards.

25. The method of claim 23, wherein the straight output tray swings the first branch board when the straight output tray is opened.

26. The method of claim 25, furthering comprising:

swinging upward a swing member contacted by the straight output tray when the straight output tray is opened, so as to engage with the first branch board to move the first branch board.

27. The method of claim 26, wherein the swing member includes an elastic member.

28. The method of claim 23, wherein the image forming unit includes a liquid drop discharging head for discharging a liquid drop of recording liquid to form the image.

29. The method of claim 28, further comprising:

arranging the first and second branch boards near a downstream end of the straight conveyance path in a sheet conveyance direction.

30. A method for image forming comprising:

providing a first conveyance path for outputting a recording sheet face down, a second conveyance path for outputting a recording sheet face up, and a third conveyance path for outputting a recording sheet on both sides of which images are formed;

providing a straight output tray to receive sheets fed through said second conveyance path;

providing a first branch board interlocked with the straight output tray and configured to independently swing to switch to any of the first conveyance path and the second conveyance path;

providing a second branch board configured to sandwich, together with the first branch board, the second conveyance path;

conveying a recording sheet with an image formed by an image forming unit;

independently swinging one of first and second branch boards sandwiching the second conveyance path to switch to any one of the first conveyance path and the second conveyance path; and simultaneously swinging the first and second branch boards to switch to the third conveyance path.

31. The method of claim 30, further comprising:

arranging the first and second branch boards in a manner that the first and second branch boards have a same axis for swinging.

32. The method of claim 30, further comprising:

rotatably connecting the first and second branch boards with each other.

33. The method of claim 30, wherein one of the first and second branch boards is rotatably supported by the other of the first and second branch boards.

* * * * *